US008016071B1

(12) United States Patent
Martinus et al.

(10) Patent No.: US 8,016,071 B1
(45) Date of Patent: Sep. 13, 2011

(54) MULTI-STAGE LOW PRESSURE DROP MUFFLER

(75) Inventors: Ferdy Martinus, Onalaska, WI (US); Gang Wang, Holmen, WI (US); Thomas J. Benedict, Winona, MN (US); Brad A. Boecker, La Crosse, WI (US); William B. Rockwood, Onalaska, WI (US)

(73) Assignee: Trane International Inc., Piscataway, NJ (US)

( * ) Notice: Subject to any disclaimer, the term of this patent is extended or adjusted under 35 U.S.C. 154(b) by 0 days.

(21) Appl. No.: 12/819,782

(22) Filed: Jun. 21, 2010

(51) Int. Cl.
*F01N 1/08* (2006.01)
*F01N 1/02* (2006.01)
*F01N 13/00* (2010.01)
*F01N 1/00* (2006.01)

(52) U.S. Cl. ..... 181/282; 181/403; 181/268; 181/272; 181/275

(58) Field of Classification Search ..... 181/282, 181/403, 268, 272, 275, 269; 417/312
See application file for complete search history.

(56) References Cited

U.S. PATENT DOCUMENTS

| | | | | | |
|---|---|---|---|---|---|
| 659,834 | A | * | 10/1900 | Thamsen | 181/239 |
| 674,210 | A | * | 5/1901 | Loomis | 181/239 |
| 737,443 | A | * | 8/1903 | Mooers | 181/268 |
| 787,860 | A | * | 4/1905 | Sharpe | 181/265 |
| 1,087,468 | A | * | 2/1914 | Steinmetz | 181/269 |
| 1,539,595 | A | * | 5/1925 | Powell | 181/281 |
| 2,122,086 | A | * | 6/1938 | Chase | 181/269 |
| 2,241,010 | A | * | 5/1941 | Chipley | 181/272 |
| 2,297,046 | A | * | 9/1942 | Bourne | 181/250 |
| 2,325,352 | A | * | 7/1943 | Wilson | 181/229 |
| 2,416,452 | A | * | 2/1947 | Marx | 181/272 |
| 2,720,935 | A | * | 10/1955 | Lysholm et al. | 181/257 |
| 2,872,998 | A | * | 2/1959 | Tinker | 181/268 |
| 2,896,739 | A | * | 7/1959 | Kuras | 181/239 |
| 2,919,761 | A | * | 1/1960 | Smith | 181/272 |
| 3,016,972 | A | * | 1/1962 | Dugas | 181/268 |
| 3,070,977 | A | * | 1/1963 | Kimmel et al. | 62/473 |
| 3,171,506 | A | * | 3/1965 | Hald | 181/265 |
| 3,454,129 | A | * | 7/1969 | Everett | 181/268 |
| 3,470,979 | A | * | 10/1969 | Everett | 181/268 |
| 3,665,965 | A | * | 5/1972 | Baumann | 138/42 |
| 4,011,922 | A | * | 3/1977 | Goplen | 181/272 |
| 4,064,962 | A | * | 12/1977 | Hunt | 181/272 |
| 4,108,276 | A | * | 8/1978 | Hall et al. | 181/256 |
| 4,203,503 | A | * | 5/1980 | Franco et al. | 181/272 |
| 4,209,076 | A | * | 6/1980 | Franco et al. | 181/272 |
| 4,241,805 | A | * | 12/1980 | Chance, Jr. | 181/232 |
| 4,253,542 | A | * | 3/1981 | Ruspa et al. | 181/272 |

(Continued)

FOREIGN PATENT DOCUMENTS

GB 2027489 A * 2/1980

(Continued)

*Primary Examiner* — Edgardo San Martin
(74) *Attorney, Agent, or Firm* — Michael Best & Friedrich LLP

(57) ABSTRACT

A multi-stage low pressure drop muffler for a compressor including a first plate having a hole, a tube attached to the first plate, a plurality of holes disposed around the circumference of the tube, a plurality of tubes extending through a second plate, and an internal ring disposed on the second plate between the center of the second plate and the plurality of tubes. The muffler is designed to muffle a wide range of frequencies, minimize pressure reduction, improve fluid flow, and improve compressor efficiency.

15 Claims, 4 Drawing Sheets

U.S. PATENT DOCUMENTS

| | | | | | |
|---|---|---|---|---|---|
| 4,330,239 | A | * | 5/1982 | Gannaway | 417/312 |
| 4,375,841 | A | * | 3/1983 | Vielbig | 181/272 |
| 4,605,092 | A | * | 8/1986 | Harris et al. | 181/280 |
| 4,635,753 | A | * | 1/1987 | Itani | 181/279 |
| 4,890,691 | A | * | 1/1990 | Ching-ho | 181/264 |
| 5,170,019 | A | * | 12/1992 | Lee | 181/204 |
| 5,214,937 | A | * | 6/1993 | Henrichs et al. | 62/468 |
| 5,475,189 | A | * | 12/1995 | Field et al. | 181/241 |
| 5,496,156 | A | * | 3/1996 | Harper et al. | 417/312 |
| 5,667,371 | A | * | 9/1997 | Prenger et al. | 418/55.1 |
| 5,705,777 | A | * | 1/1998 | Flanigan et al. | 181/252 |
| 5,859,393 | A | * | 1/1999 | Cummins et al. | 181/257 |
| 5,938,411 | A | * | 8/1999 | Seo | 417/312 |
| 6,129,522 | A | * | 10/2000 | Seo | 417/312 |
| 6,220,839 | B1 | * | 4/2001 | Sheridan et al. | 418/55.1 |
| 6,446,454 | B1 | * | 9/2002 | Lee et al. | 62/296 |
| 6,494,690 | B2 | * | 12/2002 | Seo | 417/415 |
| 6,824,365 | B2 | * | 11/2004 | Park et al. | 417/312 |
| 7,086,497 | B2 | * | 8/2006 | Cole et al. | 181/248 |
| 7,578,659 | B2 | * | 8/2009 | Fox et al. | 417/312 |
| 2006/0171819 | A1 | * | 8/2006 | Fox et al. | 417/312 |

FOREIGN PATENT DOCUMENTS

| | | | | |
|---|---|---|---|---|
| JP | 61207814 | A | * | 9/1986 |
| JP | 05288047 | A | * | 11/1993 |

* cited by examiner

MULTI-STAGE LOW PRESSURE DROP MUFFLER

BACKGROUND

The present invention relates to a multi-stage low pressure drop muffler for a compressor.

Mufflers are used on compressors in order to muffle the sound leaving the compressor. One type of compressor is a screw compressor, which generally includes two cylindrical rotors mounted on separate shafts inside a casing. The rotors rotate at high rates of speed, providing a continuous pumping action. While providing the continuous pumping action, the rotors produce pressure pulses as the pressurized fluid is discharged. These discharge pulsations act as sources of audible sound within the system. Mufflers are used to minimize the discharge pulsations, thus quieting the audible sound within the system.

SUMMARY

In one embodiment, the invention provides a muffler for a compressor. The muffler includes a first plate having a hole disposed thereon, a tube attached to the first plate, a plurality of holes disposed around the circumference of the tube, a second plate, a plurality of tubes disposed on and extending through the second plate, and an internal ring disposed on the second plate between the plurality of tubes and the center of the second plate.

In another embodiment, the invention provides a muffler for a compressor. The muffler includes an outer wall defining an interior cavity having an inlet and an outlet, an interior wall disposed within the cavity and defining a first chamber upstream of the interior wall and a second chamber downstream of the interior wall, and a plurality of tubes extending through the interior wall, the plurality of tubes being sized differently relative to each other to attenuate a range of sound frequencies.

In another embodiment, the invention provides a muffler for a compressor. The muffler includes an outer wall defining an interior cavity having an inlet and an outlet, an interior wall disposed within the cavity and having an opening thereon, the interior wall defining a first chamber upstream of the interior wall and a second chamber downstream of the interior wall, a tube including an upstream end attached to the interior wall around the opening, a closed downstream end, a plurality of holes disposed on a circumference of the tube, and a plate disposed within the tube between the upstream and downstream ends, the plate having an opening.

In another embodiment, the invention provides a method of muffling the discharge of a compressor. The method includes moving a pressurized fluid through an opening on a first plate, moving a pressurized fluid through a plurality of openings disposed around the circumference of a tube, the tube being attached to the first plate, and moving the pressurized fluid through a plurality of tubes extending through and disposed on a second plate, the plurality of tubes being disposed between an internal ring and the outer edge of the second plate.

In another embodiment, the invention provides a compressor system. The compressor system includes a fluid compressor, a muffler attached to the fluid compressor, the muffler including a first plate having a hole disposed thereon, a tube attached to the first plate, a plurality of holes disposed around the circumference of the tube, a second plate, a plurality of tubes disposed on and extending through the second plate, and an internal ring disposed on the second plate between the plurality of tubes and the center of the plate.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
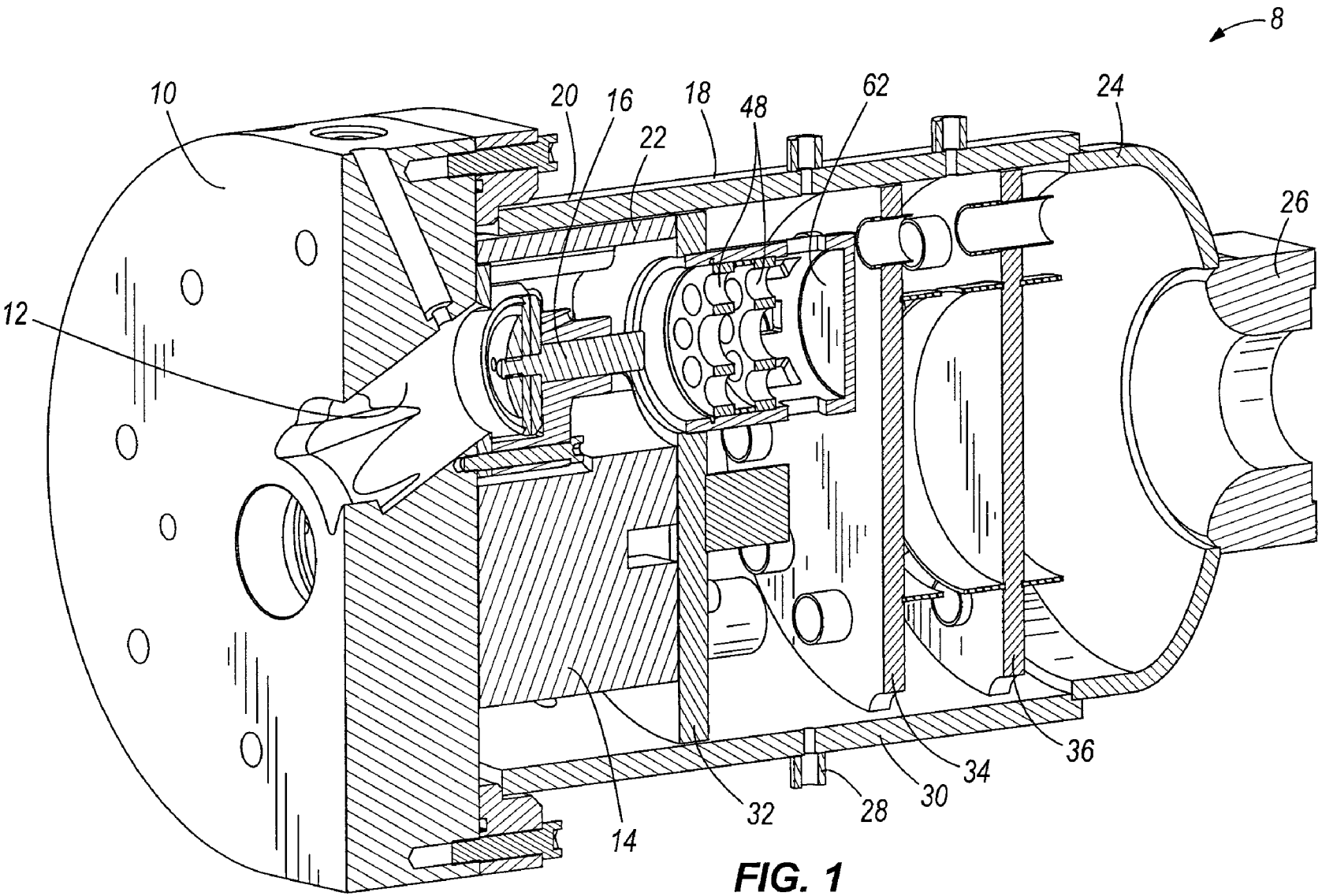
FIG. 1 is a cutaway view of a multi-stage low pressure drop muffler attached to a compressor discharge port.

FIG. 1 illustrates a cutaway view of a multi-stage low pressure drop muffler 8, which can be attached to a refrigerant compressor (not shown). The compressor can be a screw compressor which is used to compress a refrigerant in an HVAC chiller application. In other embodiments, the compressor can be used for other purposes (e.g., as an air compressor). The compressor includes a discharge plate 10 having a discharge port 12. A shaft support member 14 is coupled to the discharge plate 10 to support an end of the compressor shaft (not shown). The shaft support member 14 includes a cavity that houses a check valve 16 such that the check valve 16 is aligned with an end of the discharge port 12.

The muffler 8 has an outer wall 18 which is generally tubular in shape. An upstream end 20 of the outer wall 18 is coupled to the discharge plate 10 such that the shaft support member 14 and the check valve 16 are enclosed within the outer wall 18 and the discharge plate 10. The wall of the shaft support member 14 around the cavity defines a second wall 22 internal to the outer wall 18 thereby creating a double wall section along a portion of the muffler 8. In other embodiments, the second wall 22 could extend the entire length of the muffler 8. A downstream end 24 of the outer wall tapers to a smaller diameter exit tube 26 defining a muffler outlet. An oil drain opening 28 is placed on the outer wall 18 of muffler 8, in a middle portion 30 of the muffler 8. In one embodiment multiple oil drain openings are utilized in various sections of the muffler 8.

The muffler 8 is divided into a plurality of chambers by first, second, and third plates 32, 34, 36. The first, second, and third plates 32, 34, 36 may also be referred to as first, second, and third interior walls. The first circular plate 32 is coupled at its edges to the inside surface of the outer wall 18 and is spaced from the discharge plate 10 a distance in the downstream direction to define a chamber (i.e. an upstream discharge cavity) between the discharge plate 10 and the first plate 32. The second circular plate 34 is coupled at its edges to the inside surface of the outer wall 18 and is spaced from the first plate 32 a distance in the downstream direction to define a first expansion chamber between the first plate 32 and the second plate 34. The third plate 36 is coupled at its edges to the inside surface of the outer wall 18 and is spaced from the second plate 34 a distance in the downstream direction to define a second expansion chamber between the second plate 34 and the third plate 36 and a third expansion chamber between the third plate 36 and the exit tube 26.

Figure 2:
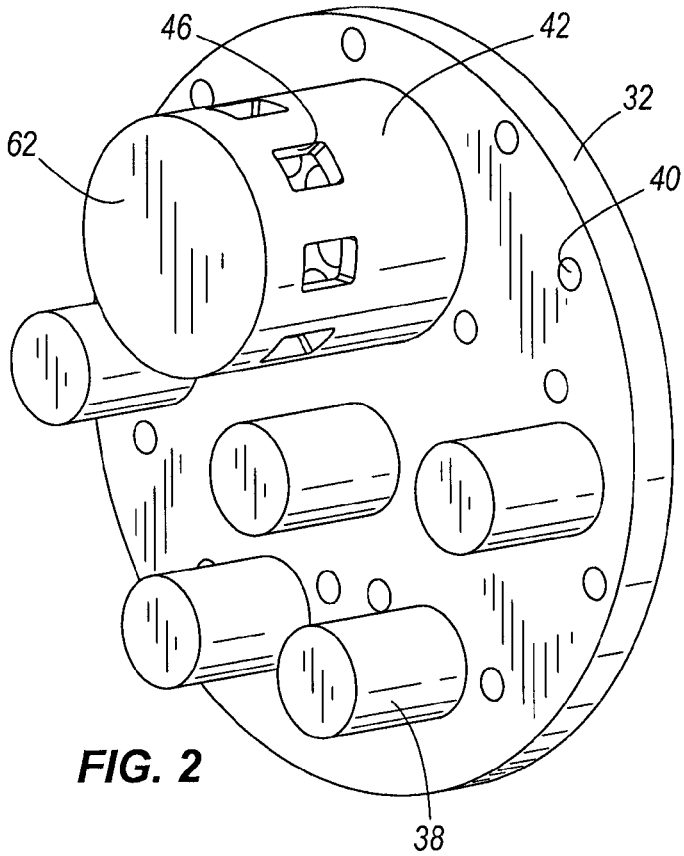
FIG. 2 is a perspective view of a first plate of the muffler of FIG. 1.

As shown in FIG. 2, the first plate 32 is circular and is sized to closely match the internal diameter of the outer wall 18 of the muffler 8. A first plurality of internal resonance disruptors 38 is disposed on the downstream side of the first plate 32 within the first expansion chamber. The first plurality of internal resonance disruptors 38 are tubular in shape. In other embodiments the first plurality of internal resonance disruptors 38 may take on other shapes such as cubes, prisms, pyramids or irregular shapes. A second plurality of internal resonance disruptors 40 is disposed on the downstream side of the first plate exposed to the first expansion chamber. The second plurality of internal resonance disruptors 40 comprise indentations in the first plate and are in the shape of one-half of a sphere. Other shapes are contemplated for the second plurality of internal resonance disruptors 40. The first plurality of internal resonance disruptors 38 and the second plurality of internal resonance disruptors 40 may be placed at various locations on the downstream side of the first plate 32.

A discharge tube 42 is coupled to the first plate 32. In one embodiment, a center axis of the discharge tube 42 coincides with a center axis of the check valve 16. The discharge tube 42 is tubular in shape. The upstream end of the discharge tube 42 is open and the downstream end of the discharge tube 42 is solid. An internal wall 44 of the discharge tube 42 defines a hollow cavity therein. The discharge tube 42 has a plurality of perimeter holes 46 disposed around the perimeter of the tubular section of the discharge tube 42, approximately half-way between the first end and a middle section of discharge tube 42. In one embodiment the holes 46 disposed around the perimeter of the tubular section of the discharge tube 42 are arranged approximately 0.5 inches from the downstream end of the discharge tube 42. The plurality of perimeter holes 42 are evenly spaced and each is rectangular in shape. Other embodiments contemplate the plurality of holes 42 having a variety of shapes such as a circular shape, a hexagonal shape, or an irregular shape.

Figure 3:
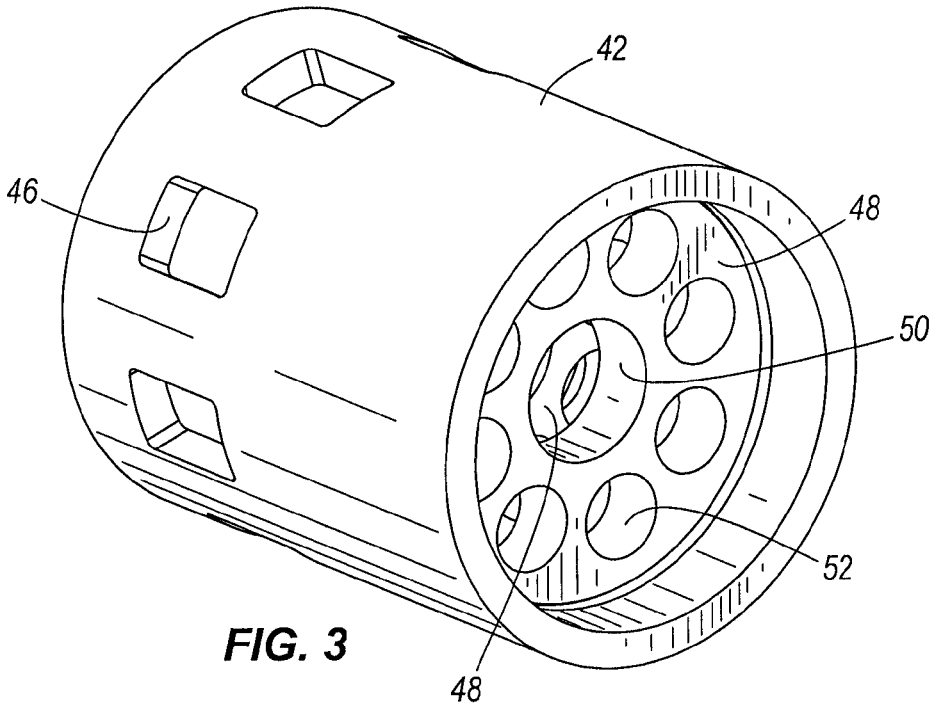
FIG. 3 is a perspective view of a discharge tube of the muffler of FIG. 1.

As illustrated in FIGS. 1 and 3, two flow expansion plates 48 are disposed one after the other in the interior of the discharge tube 42. The flow expansion plates 48 are spaced a distance from the upstream end of the discharge tube 42. Each flow expansion plate 48 of the embodiment shown in FIG. 3 includes a center hole 50 in the flow expansion plate 48 and a plurality of perimeter holes 52 disposed in a circular fashion on the flow expansion plate 48. In some embodiments, the diameter of the center hole 50 is 1 inch and the diameter of each perimeter hole 52 in the flow expansion plate 48 is 0.6 inches.

Figure 4:
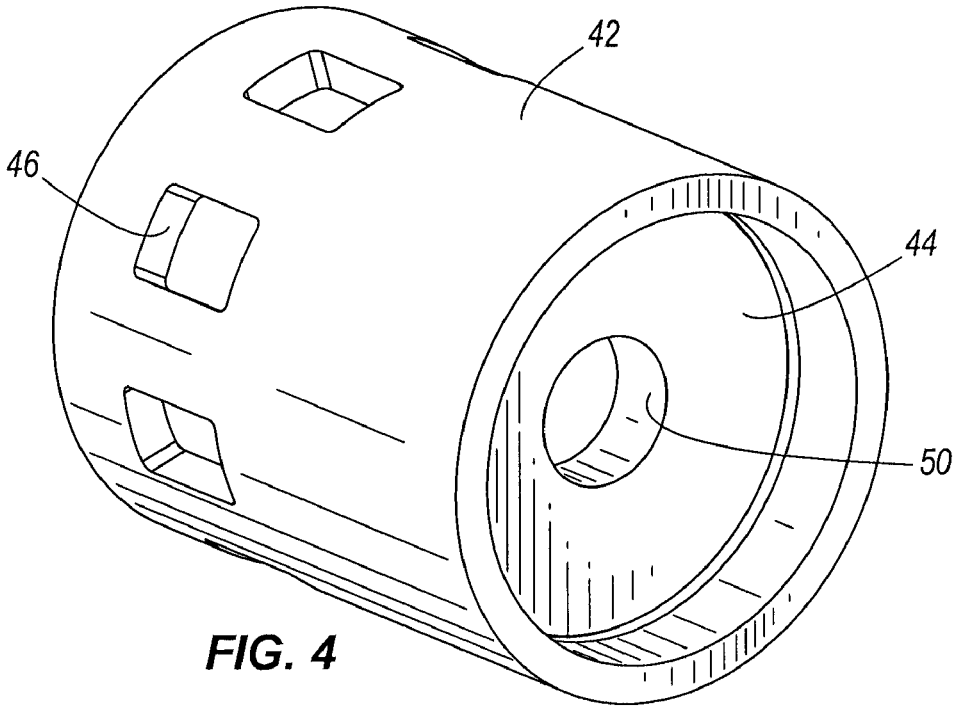
FIG. 4 is a perspective view of another construction of the discharge tube shown in FIG. 3.

In other constructions, only a single flow expansion plate may be used. For example, as shown in FIG. 4, a single flow expansion plate 44 is disposed in the interior of the discharge tube 42 and spaced a distance from the upstream end of the discharge tube 42. The single flow expansion plate 44 includes a single centrally-located hole 50.

Figure 5:
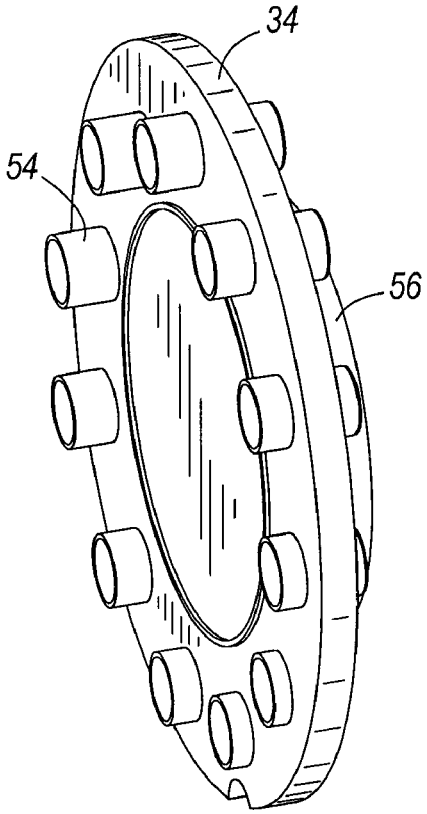
FIG. 5 is a perspective view of a second plate of the muffler of FIG. 1.

As illustrated in FIG. 5, the second plate 34 is circular and is sized to closely match the inner diameter of the outer wall 18 of the muffler 8. A plurality of frequency tubes 54 is disposed on the second plate 34 in a circular fashion. The plurality of frequency tubes 54 extends through the second plate 34 and extends from the second plate 34 into both the first and second expansion chambers. Each frequency tube 54 has a central axis which is parallel to the central axis of the discharge tube 42. The frequency tubes 54 are disposed on the second plate 34 some distance from the outer wall 18 of the muffler 8 (approximately 1.125 inches in one embodiment). The frequency tubes 54 have approximately equal diameters, but the frequency tubes 54 are different lengths (e.g., increasing incrementally from 1 inch to 2 inches in length). In one embodiment eleven frequency tubes 54 are disposed on the second plate 34, however, a greater or lesser number of frequency tubes 54 may be utilized. A first internal ring 56 is disposed on the downstream side of the second plate 34. The first internal ring 56 is disposed between a center axis of the second plate 34 and the frequency tubes 54 disposed on the second plate 34. In some embodiments, the distance between the frequency tubes 54 and the first internal ring 56 is 1.125 inches.

Figure 6:
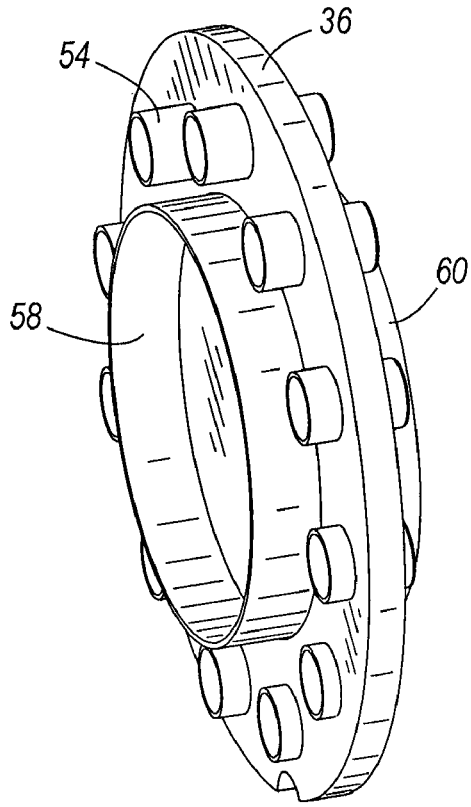
FIG. 6 is a perspective view of a third plate of the muffler of FIG. 1.

As shown in FIG. 6, the third plate 36 is circular and is sized to closely match the inner diameter of the outer wall 18 of the muffler 8. A plurality of frequency tubes 54 is disposed on the third plate 36 in a circular fashion. The plurality of frequency tubes 54 extends through the third plate 36 and extends from the third plate 36 into both the first and second expansion chambers. Each frequency tube 54 has a central axis which is parallel to the central axis of the discharge tube 42. The frequency tubes 54 are disposed on the third plate 36 some distance from the outer wall 18 of the muffler 8 (approximately 1.125 inches in one embodiment). The frequency tubes 54 have approximately equal diameters, but the frequency tubes 54 are different lengths (e.g., increasing incrementally from 1 inch to 2 inches in length). In one embodiment eleven frequency tubes 54 are disposed on the third plate 36, however, a greater or lesser number of frequency tubes 54 may be utilized. Second and third internal rings 58, 60 are disposed on opposite sides of the third plate 36. The second and third internal rings 58, 60 are disposed between a center axis of the third plate 36 and the frequency tubes 54 disposed on the third plate 36. In some embodiments, the distance between the frequency tubes 54 and the second and third internal rings 58, 60 is between 1 and 1.25 inches, preferably 1.125 inches. Other embodiments contemplate the second and third internal rings 58, 60 having various shapes, such as a rectangular shape, a hexagonal shape, or an irregular shape.

Figure 7:
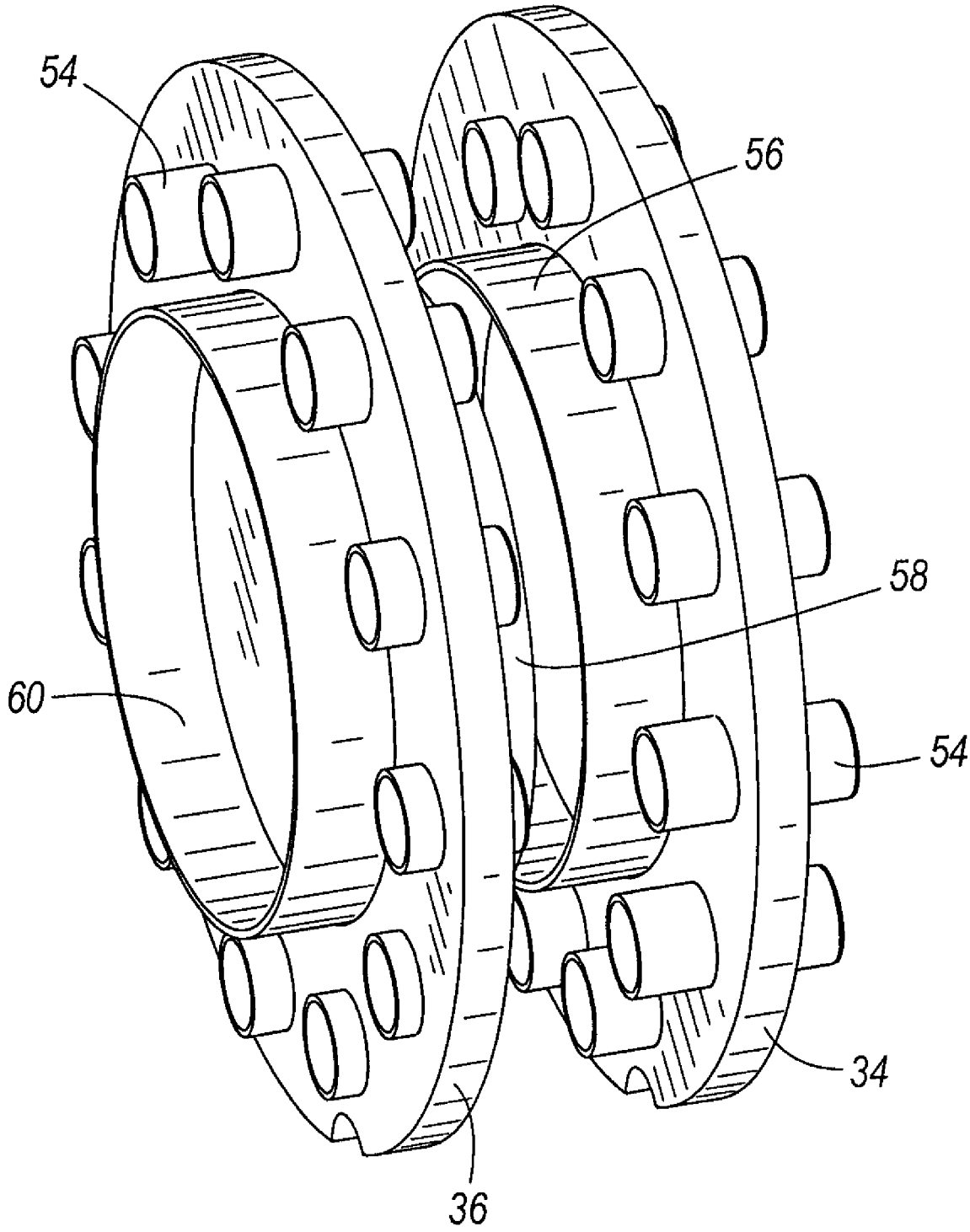
FIG. 7 is a perspective view of the second and third plates of the muffler of FIG. 1.

As shown in FIG. 7, the frequency tubes 54 of the second and third plates 34, 36 are arranged such that each frequency tube 54 of the second plate 34 shares a common axis with a corresponding frequency tube 54 of the third plate 36. In addition, the length of the frequency tubes 54 on the second plate 34 is inversely proportional to the length of the corresponding frequency tube 54 on the third plate 36. For example, the longest frequency tube 54 on the second plate 34 is aligned with the shortest frequency tube 54 of the third plate 36, and vice versa. In this arrangement, the combined length of the aligned pairs of frequency tubes 54 of the second and third plate 34, 36 are substantially equal. In other embodiments, the axes of the frequency tubes 54 of the second plate 34 can be angularly offset from the axes of the frequency tubes 54 of the third plate 36. In other embodiments, the frequency tubes 54 on the second plate 34 can be positioned independent of the arrangement of the frequency tubes 54 on the third plate 36.

The function of the muffler 8 and the associated benefits will now be described. When the compressor is operating, a pressurized fluid is discharged from the compressor discharge port 12. The pressurized fluid then passes through the check valve 16. One function of the check valve 16 is to ensure that if the pressure in the compressor drops that the pressurized fluid in the muffler 8 does not feed back into the compressor, which can damage the compressor. In the disclosed embodiment, the compressor discharge port 12 and check valve 16 are offset from the center axis of the muffler 8. The compressor discharge port 12 and check valve 16 are offset to allow room for the compressor shaft support member 14.

After passing through the check valve 16, the pressurized fluid must pass through the discharge tube 42. The pressurized fluid first passes through the flow expansion plate 48. As described above, one embodiment of the flow expansion plate 44 has only one hole 50 in the center of the plate. One benefit of the flow expansion plate 48 is that it breaks upstream resonances. A flow expansion plate 48 is necessary to break the upstream resonances because without a flow expansion plate 48 the resonances would pass straight into the discharge tube 42. Another embodiment of the flow expansion plate 48 has a plurality of holes 52 disposed on the flow expansion plate 48. The embodiment illustrated in FIG. 3 includes a center hole 50 and a plurality of holes 52 arranged in a circular shape. The embodiment illustrated in FIG. 3 serves to break upstream resonances while not creating a pressure build-up upstream of the of the flow expansion plate 48. A pressure build-up is not beneficial because it forces the compressor to consume additional energy.

A key benefit of the flow expansion plate 48 is that it breaks upstream resonances which allows the muffler 8 to be used on any compressor or a variable-speed compressor capable of producing a broad range of upstream resonances. Different compressors create noise at different pressures and frequencies. An analogy is a car exhaust. Various cars sound different because the exhaust of each car is output at a different pressure and frequency. A muffler, for a car or a compressor, must be tuned in order to ensure that maximum dampening is occurring at the output pressure and frequency. The tuning of the muffler is costly because it results in a different muffler for each car or compressor. The flow expansion plate 48 breaks upstream resonances, thus eliminating or minimizing large pressure pulsations at certain frequencies. The elimination of large pressure pulsations at certain frequencies allows the disclosed invention to be effective on any compressor, eliminating the need to provide a different muffler for each compressor design. In one embodiment a center hole 50 has a diameter of approximately 1", the purpose of the center hole 50 being to induce expansions and contractions of the sound field which reduces the potential of standing wave generation. In the same embodiment, a plurality of holes 52, each hole having a diameter of less than 0.6", is disposed on the flow expansion plate 48 to minimize pressure drop.

After passing through the flow expansion plate 48, the pressurized fluid then enters into an area defined by the tubular section of the discharge tube 42, the flow expansion plate 48, and a first end 62 of the discharge tube 42. The pressurized fluid then exits the discharge tube 42 through the plurality of perimeter holes 46 of the discharge tube 42. The plurality of perimeter holes 46 are located a distance away from the first end 62 of the discharge tube 42 because the pressure is highest at the first end 62 of the discharge tube 42. The location of the perimeter holes 46 ensures that the highest pressure and pulsation levels do not enter into the first expansion chamber of the muffler 8. The location of the perimeter holes 46 also forces the pressurized fluid to make a ninety degree turn before the pressurized fluid is able to enter the first expansion chamber of the muffler 8. As the pressurized fluid enters the discharge tube 42, it is flowing in a direction that is substantially parallel to the center axis of the muffler 8. However, as the first end 62 of the discharge tube 42 is solid, the pressurized fluid must turn 90 degrees in order to exit the discharge tube 42.

After the pressurized fluid has left the discharge tube 42, it passes into the first expansion chamber of the muffler 8. The first and second plurality of resonance disruptors 38, 40 serve to disrupt pressure waves and pulsations. Disrupting the pressure waves and pulsations serves to ensure that high pressure waves and pulsations do not directly enter the second expansion chamber of the muffler 8. In the disclosed embodiment the first plurality of resonance disruptors 38 are tubular in shape, however, other shapes are contemplated. In the disclosed embodiment, the second plurality of resonance disruptors 40 is indentations in the first plate 32. The resonance disruptors 40 that are indentations in the first plate 32 serve the same purpose as the resonance disruptors 38 that are tubular in shape, to disrupt pressure waves and pulsations.

The pressurized fluid is able to exit the first expansion chamber of the muffler 8 by passing through frequency tubes 54 in the second plate 34. In the disclosed embodiment, frequency tubes 54 are used on the second plate 34 without an internal ring on the upstream side. However, other embodiments contemplate using an internal ring in combination with frequency tubes 54 on both sides of the second plate 34. The frequency tubes 54 are designed to correlate to certain frequencies. The frequency tube length is used to tune the frequency tube 54 to a specific frequency. Thus the various frequency tubes 54 are of different lengths. Placing a plurality of frequency tubes 54 of different lengths in one muffler 8 allows the muffler 8 to attenuate a wide range of sound frequencies. In one embodiment, the plurality of frequency tubes 54 are sized to attenuate the range of sound frequencies discharged in a variety of compressors, allowing the muffler 8 to be effective on many different compressors without requiring that the muffler 8 be tuned to a specific compressor. In the disclosed embodiment eleven frequency tubes 54 are used on the second plate 34. A corresponding number of frequency tubes 54 are also used on the third plate 36. However, other embodiments may use a greater or lesser number of frequency tubes 54 on each plate. The disclosed embodiment allows the muffler 8 to be effective within a broad frequency range, in this embodiment up to 2500 Hz. In the disclosed embodiment the frequency tubes 54 are tubular, but other embodiments may use frequency tubes 54 of different shapes.

After passing through the frequency tubes 54 in the second plate 34, the pressurized fluid enter the second expansion chamber of the muffler 8. The pressurized fluid is able to exit the second expansion chamber of the muffler 8 by passing through frequency tubes 54 in the third plate 36. The frequency tubes 54 are a similar design to the frequency tubes 54 disposed on the second plate 34. The first, second, and third internal rings 56, 58, 60 allow for stronger resonances to be developed between the frequency tubes 54 and the internal rings 56, 58, 60.

After passing through the frequency tubes 54 in the third plate 36, the pressurized fluid enters the third expansion chamber of the muffler 8. The third expansion chamber of the muffler 8 has a portion with a larger diameter and the exit tube 26 which has a smaller diameter. The frequency tubes 54 are arranged so that the center axis of each frequency tube 54 is lined up with a transition portion between the larger diameter and the smaller diameter of the downstream portion 24 of the muffler 8. The frequency tubes 54 are arranged in such a manner to ensure that the pressurized fluid does not flow straight from the frequency tubes 54 to the exit tube 26 of the muffler 8. The exit tube 26 is open, allowing the pressurized fluid to leave the muffler 8.

Thus, the invention provides, among other things, a multi-stage low pressure drop muffler for a compressor. Various features and advantages of the invention are set forth in the following claims.

What is claimed is:

1. A muffler for a compressor, the muffler comprising:

an outer wall defining an interior cavity having an inlet and an outlet;

a first interior wall disposed within the cavity and having an opening thereon;

a tube including an upstream end attached to the first interior wall around the opening, a closed downstream end, a plurality of holes disposed on a circumference of the tube, and a first plate disposed within the tube between the upstream and downstream ends, the first plate having an opening, the opening of the first plate and the plurality of holes having different shapes;

a plurality of internal resonance disruptors projecting from the downstream side of the first interior wall;

a second interior wall disposed within the cavity downstream of the first interior wall;

at least three tubes extending through the second interior wall and arranged in a circular pattern, each of the at least three tubes having a length different from the length of any of the other of the at least three tubes to attenuate a range of sound frequencies.

2. The muffler of claim 1 wherein each tube of the at least three tubes has a length of between 1 and 2 inches.

3. The muffler of claim 1 wherein at least one tube of the at least three tubes has a substantially circular cross section.

4. The muffler of claim 1 wherein at least one of the at least three tubes extending through the second interior wall has a cross sectional area that is different from the remaining tubes of the plurality of tubes.

5. The muffler of claim 1, further comprising an internal ring disposed on the second interior wall and inside of the at least three tubes relative to the outer wall.

6. The muffler of claim 5 wherein the internal ring is disposed approximately 1.125 inches from the at least three tubes.

7. The muffler of claim 6 wherein the range of frequencies attenuated range from 0 Hz to 2500 Hz.

8. The muffler of claim 1 wherein at least one of the plurality of holes disposed on the circumference of the tube and the opening are circular; and at least one of the plurality of holes disposed on the circumference of the tube and the opening are rectangular.

9. The muffler of claim 8 wherein the first plate has a plurality of openings thereon.

10. The muffler of claim 1 further comprising an additional plate disposed within the tube between the upstream and downstream ends, the additional plate having an additional opening.

11. The muffler of claim 10 wherein the additional opening on the additional plate and the opening on the first plate are aligned.

12. The muffler of claim 10 wherein the additional plate includes an additional plurality of openings thereon.

13. The muffler of claim 12 wherein one of the additional openings is centrally located on the additional plate and is approximately 1 inch in diameter and the remaining additional openings are arranged in a circular pattern, and each of the remaining additional openings has a diameter of less than 0.6 inches.

14. The muffler of claim 10 wherein the plurality of holes are disposed approximately 0.5 inches from the closed downstream end of the tube.

15. The muffler of claim 1 wherein the plurality of holes are disposed approximately 0.5 inches from the closed downstream end of the tube.

* * * * *